US008491757B2

(12) United States Patent
Lonardi et al.

(10) Patent No.: US 8,491,757 B2
(45) Date of Patent: Jul. 23, 2013

(54) COKE OVEN OFFTAKE PIPING SYSTEM

(75) Inventors: Emile Lonardi, Bascharage (LU); Thomas Hansmann, Trier (DE); Stefano Pivot, Genoa (IT); Maurizio Bisogno, Genoa (IT)

(73) Assignee: Paul Wurth S.A., Luxembourg (LU)

( * ) Notice: Subject to any disclaimer, the term of this patent is extended or adjusted under 35 U.S.C. 154(b) by 778 days.

(21) Appl. No.: 12/663,668

(22) PCT Filed: Jun. 4, 2008

(86) PCT No.: PCT/EP2008/056888

§ 371 (c)(1), (2), (4) Date: Dec. 8, 2009

(87) PCT Pub. No.: WO2008/148783

PCT Pub. Date: Dec. 11, 2008

(65) Prior Publication Data

US 2010/0187087 A1 Jul. 29, 2010

(30) Foreign Application Priority Data

Jun. 8, 2007 (EP) ..... 07109924

(51) Int. Cl.
*C10B 27/06* (2006.01)

(52) U.S. Cl.
USPC ..... 202/254; 201/1; 202/256; 202/258

(58) Field of Classification Search
USPC ..... 202/254, 255, 256, 257, 258, 260, 202/269; 201/1, 41; 137/247.19; 251/301, 251/302
See application file for complete search history.

(56) References Cited

U.S. PATENT DOCUMENTS

| | | | | |
|---|---|---|---|---|
| 1,517,786 | A | 12/1924 | Kus | |
| 1,540,513 | A | 6/1925 | Cavett | |
| 1,746,142 | A | 2/1930 | Butler | |
| 2,603,232 | A | 7/1952 | Keammerer | |
| 2,759,885 | A * | 8/1956 | Thompson, Jr. | 202/256 |
| 3,243,360 | A * | 3/1966 | Wethly | 202/256 |
| 3,804,721 | A | 4/1974 | Gidick | |
| 4,599,140 | A * | 7/1986 | Bauer | 201/1 |
| 7,097,743 | B2 | 8/2006 | Krebber et al. | |

FOREIGN PATENT DOCUMENTS

| | | |
|---|---|---|
| EP | 1746142 | 1/2007 |
| WO | 02/066576 | 8/2002 |

OTHER PUBLICATIONS

International Search Report; PCT/EP2008/056888; Oct. 21, 2008.

* cited by examiner

*Primary Examiner* — Jill Warden
*Assistant Examiner* — Joye L. Woodard
(74) *Attorney, Agent, or Firm* — Cantor Colburn LLP

(57) ABSTRACT

A coke oven offtake piping system includes a pipe assembly for conveying coke oven gases from a coke oven to a collecting main, at least one spraying nozzle in the pipe assembly, and a discharge section with a discharge pipe having a discharge orifice. A gate member cooperates with the discharge orifice and is movable along the discharge orifice in order to present a closing surface to the extremity thereof, whereby the opening area of said discharge orifice can be varied for controlling the flow rate to the collecting main. The gate member is a spherical cap with a concave closing surface. The gate member is configured to pivot around a pivoting axis to expose the discharge orifice and to cover the discharge orifice, respectively.

18 Claims, 10 Drawing Sheets

COKE OVEN OFFTAKE PIPING SYSTEM

TECHNICAL FIELD

The present invention generally relates to coke oven construction and more specifically to an offtake piping of a coke oven with integrated flow control valve to adjust the raw gas flow from each individual oven chamber to the collecting main.

BRIEF DESCRIPTION OF RELATED ART

Conventionally in coke plants comprising a battery of coke ovens the raw gases (distillation gases and vapors) from each single oven are lead through an offtake piping to a collecting main extending typically over the entire length of the battery of coke ovens. The offtake piping itself typically comprises a standpipe (also known as riser or ascension pipe) extending upwardly from the oven roof and a gooseneck, i.e. a short curved pipe communicating with the top of the standpipe and leading to the collecting main. One or more spraying nozzles are arranged in the gooseneck to cool (quench) the raw gases from about 700-800° C. down to a temperature of about 80-100° C.

In order to individually control the gas pressure in each coke oven chamber, it is known to provide a control valve in the offtake piping or at its discharge opening in the collecting main, that allows to close and/or throttle the gas flow through the offtake piping. Such devices offer the possibility of continuously controlling the oven pressure during distillation time so as to avoid overpressure during the first phase of the distillation process, by maintaining a negative pressure in the collecting main, whereby emissions from doors, charging holes etc. can be fully reduced. Moreover, a continuous oven pressure control allows avoiding negative relative pressures at the oven bottom during the last phase of distillation when the coke gas flow rate is low.

A known type of pressure control valve is e.g. described in U.S. Pat. No. 7,709,743. This valve is arranged inside the collecting main at the discharge extremity of a vertical discharge section of the gooseneck. The valve permits controlling the backpressure in the oven chamber and is based on the adjustment of water level inside the valve, providing a variation of the valve port area through which the raw gas flows.

EP 1 746 142, which relates to a method of reducing the polluting emissions from coke ovens, uses a pot valve pivotable about a lateral axis. Each distillation chamber is connected by a gooseneck to a collecting main via such interposed pot valve. The oven pressure in the individual distillation chambers is detected by means of pressure sensors and the pot valve position is adjusted in order to control the flow rate to the collecting main depending on the pressure in the oven. In one embodiment, the valve member is provided with a curved tubular metal structure to limit the flow cross section during the beginning of the opening stroke. Despite the reliable design of this valve, it does not allow much progressivity in the flow rate control.

BRIEF SUMMARY

The disclosure provides an alternative coke oven offtake piping system with improved integrated flow control capability.

The present invention relates to a coke oven offtake piping system comprising a pipe assembly with a discharge section including a discharge pipe having a discharge orifice, a gate member cooperating with the discharge orifice for controlling the flow rate to the collecting main. At least one spraying nozzle is preferably provided for quenching the raw gas flow from the oven.

According to an important aspect of the present invention, the gate member is designed so as to be movable along the discharge orifice in order to present a closing surface to the extremity of the discharge pipe. This allows varying the opening area of the discharge orifice to control the flow rate to the collecting main.

Contrary to valves having a closure member, which is lifted off the valve seat in opening positions (as e.g. with the pot valve of EP 1 746 142), the gate member used in the present invention has an operating movement that is configured for moving along the discharge orifice. The gate member, seen with respect to the discharge orifice, is thus moved somewhat transversally in front of the discharge orifice rather than away from (resp. closer to) the discharge orifice. In practice, for high flow rates, the gate member is advantageously in a position where it does not at all cover/obstruct the discharge orifice (typically is laterally parked). Partial obturation is obtained by progressively moving the gate member below the discharge orifice to cover a desired proportion of the discharge orifice. This is, in practice, not possible with a valve design where the closure member is lifted off from the valve seat in the opening position, since it is quite difficult to precisely control the spacing between the valve member and the valve seat. Since there is no lifting movement, the part of the closing member that obstructs the discharge orifice can be maintained at a constant distance from the pipe extremity: this allows a precise control of the opening area while limiting leaks due to the operating gap between the closure member and discharge pipe.

The closing surface of the gate member may be flat or curved. In the case of a flat gate member, its operating movement can be a simple translation from the side of the discharge pipe (fully open) to a desired position under the discharge pipe to partially or fully obstruct the discharge orifice.

Alternatively, the closing surface of the gate member may be curved, in which case the closure member may describe a pivoting operating movement around a pivoting axis allowing its pivoting along the discharge orifice to obstruct a desired proportion of the discharge orifice (preferably between 0 and 100%). The gate member may thus present a generally convex or concave surface profile to the extremity of the discharge pipe, preferably with a constant curvature radius. In practice, the gate member may be a spherical or cylindrical cap.

For improved flow regulation capability towards the end of the distillation phase, at least one cut-out is advantageously arranged in the gate member or in the discharge pipe about the discharge orifice so as to form a variable section opening during a portion of the pivoting stroke of the gate member. The cut-out is preferably positioned so that, as the gate member has been progressively closed to reduce the opening area of the discharge orifice, the latter is completely obstructed by the gate member except for the opening defined by the cut-out, which itself can be reduced by further moving the gate member in the closing direction.

Such valve design with fine flow control capability provides a simple and efficient solution for precisely controlling the flow rate to the collecting main at low pressures inside the coke oven chamber (typically towards the end of the distillation phase).

The shape and number of cut-outs can be adapted at will, in order to provide the desired flow characteristics trough the valve. Preferably the cut-out(s) is(are) arranged to extend inwardly from an edge of the member in which they are provided. In case the cut-out is to be borne by the discharge pipe, it may e.g. be arranged in an inwardly extending lip at the bottom of the discharge pipe that follows the curvature of the closing member. In another embodiment cut-outs are formed by a series of holes in the gate member, arranged about an edge thereof.

For ease of implementation, the cut-out (or a plurality thereof) is arranged in the gate member so that the discharge pipe may be a simple cylindrical or frustoconical pipe. Preferably, the cut-out extends inwardly from an edge of the gate member. The cut-out is arranged in the closing member at a position where it will form a reduced, variable section opening towards the end of the closing stroke of the gate member. For example the cut-out can be provided on the leading edge of the gate member, so that as from a given position of the gate member, the gate member will completely obstruct the discharge orifice except for the opening area defined by the cut-out and the rim of the discharge opening.

Advantageously, the gate member is designed in such a way that in the closed position, its peripheral borders extend upwardly beyond the extremity of the discharge orifice, so that a hydraulic seal forms and closes the operating gap between the orifice and the gate member as process fluid collects in the gate member cavity.

Preferably, the concave (or convex) surface profile of the gate member has a centre of curvature that is substantially coaxial with the pivoting axis. This allows pivoting the gate member about the discharge orifice with a constant operating gap between the two parts. Alternatively, a slight shift between pivoting axis and curvature centre may exist, to provide a metallic contact between parts in the closed position.

In one embodiment, the discharge pipe extends in a discharge cage connecting the collecting main; and spray means are provided to spray the outer wall of the discharge pipe. Spray means are advantageously arranged in the discharge cage so that in certain partially open positions of the gate member, sprayed fluid flows between the outer wall of the discharge pipe and the gate member cavity and forms a hydraulic seal.

To avoid water accumulation in the discharge pipe up above a certain level, overflow means may be integrated in the discharge pipe, excess water being evacuated into the discharge cage.

A conventional-type pot valve may be provided downstream of the gate member to permit sealed closure of the offtake piping. However, as mentioned above, when the gate member forms a cavity with borders extending beyond the discharge orifice, such pot-valve is not needed since a hydraulic seal forms in the gate member cavity.

As illustrated in FIG. 23, any appropriate drive means may be used for pivoting the gate member about its axis at an end of the discharge pipe 20. Typically the gate member 24 may be supported by one or two arms 231, whose opposite extremities can be housed in bearings 232 coinciding with the pivoting axis A. The actuation mechanism 223 may be designed to permit manual and/or automated actuation.

In one embodiment, the closing member is a spherical cap with a truncated edge that forms a flat leading edge of the gate member. This is an interesting alternative to a full spherical cap because the leading edge can provide a narrower flow area when associated with a circular discharge orifice.

As illustrated in FIG. 24,the coke oven offtake piping system 242 according to the present invention can be associated to one or more actuator(s) 223 for its actuation. The actutaror (s) 233 is/are controlled by an electric/electronic control unit 244 also connected to pressure sensor(s) 243in the coke oven 241 chamber. The control unit 244 is advantageously configured to—based on the detected pressure—progressively adjust the position of the gate member 246 relative to the discharge orifice to provide a progressive constriction of the discharge opening as the pressure varies in the oven 241 chamber.

As illustrated in FIG. 25, the present invention also concerns a coke plant 250 comprising a battery of coke ovens 251 and a collecting main 253, wherein the gases from each single oven 251 are lead to said collecting main 253 via a coke oven offtake piping system as defined hereinabove. In a coke plant 250 equipped with such offtake piping system, the oven pressure can be continuously controlled during distillation time so as to avoid overpressure during the first phase of the distillation process, by maintaining a negative pressure in the collecting main 253, whereby emissions from doors, charging holes etc. can be fully reduced. Such continuous oven pressure control further allows avoiding negative relative pressures at the oven bottom during the last phase of distillation when the coke gas flow rate is low.

According to another aspect of the present invention, there is proposed a method of controlling the gas flow rate from coke ovens, wherein a battery of coke oven chambers are each connected by a coke oven offtake piping system as described above to a collecting main. The method comprises the steps of detecting the oven pressure in the individual coke oven chambers by means of pressure sensors, and based on the detected pressure, progressively adjusting the position of the gate member relative to the discharge orifice to provide a progressive constriction of the discharge opening as the pressure varies in the oven. This method can be implemented using appropriate actuators, e.g. solenoid-type, for the gate member that are controlled by a control circuit responsive to the pressure signals generated by the pressure sensors. The actuators may be coupled to positional transducers generating position signals received by the control unit.

BRIEF DESCRIPTION OF THE DRAWINGS

The present invention will be more apparent from the following description of several not limiting embodiments with reference to the attached drawings, wherein.

DETAILED DESCRIPTION

Figure 1:
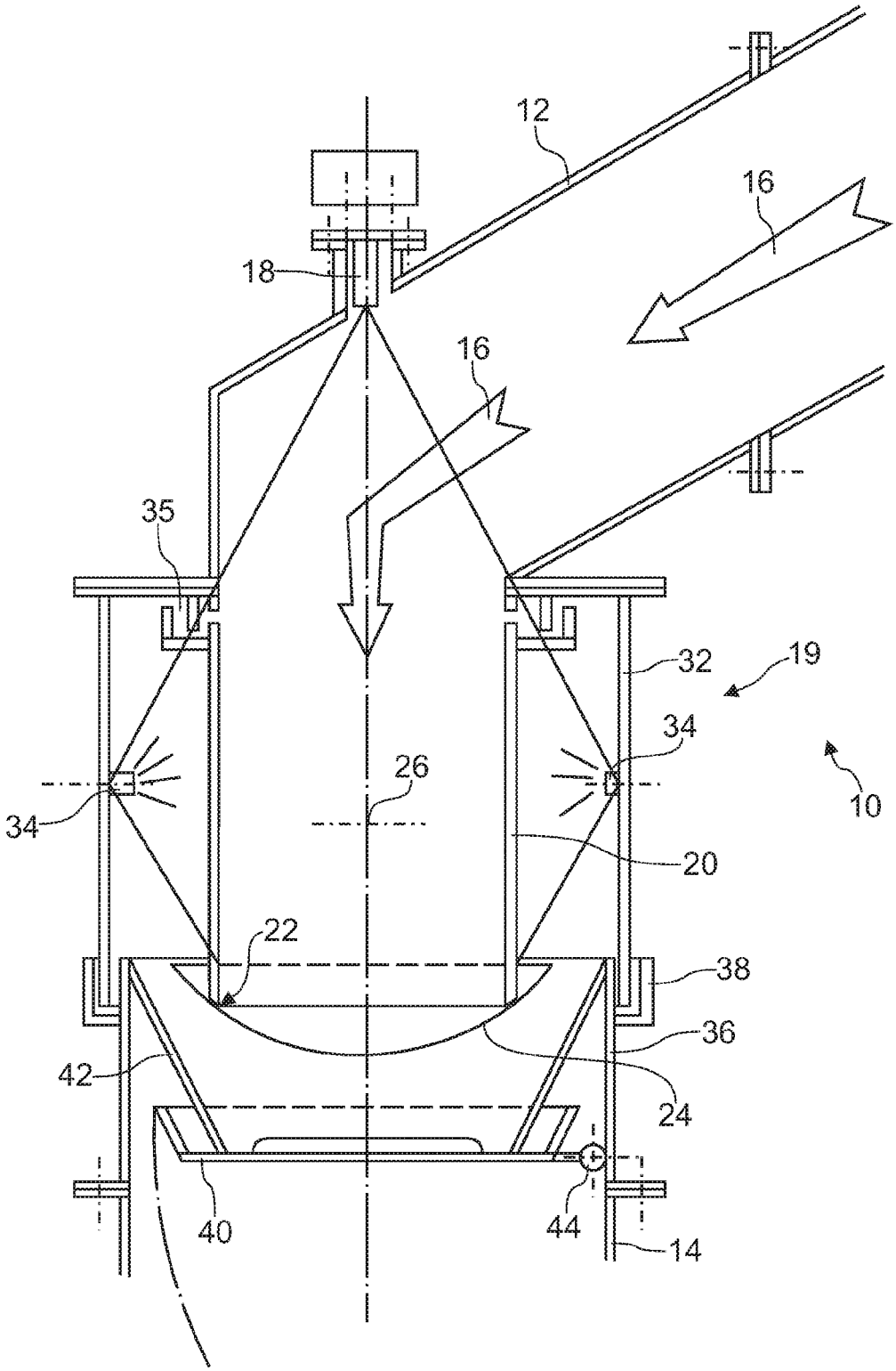
FIG. 1: is a vertical section view through a first embodiment of an coke oven offtake piping system in accordance with the present invention, the gate member being in the closed position.

FIG. 1 shows a preferred embodiment of a coke oven offtake piping system in accordance with the present invention. It comprises a piping assembly for conveying the raw distillation gas from an individual coke oven chamber to the collecting main. In the present embodiment, the piping assembly comprises a standpipe (not shown) connected at its bottom to the roof of a coke oven (not shown), e.g. a slot-type chamber of a coke oven battery. Reference sign 12 indicates a gooseneck (curved pipe) for conveying the raw coke oven gases (arrow 16) from the upper part of the standpipe to the collecting main 14 of the coke plant, which typically extends over the entire length of the battery of coke ovens. These piping elements may be conventionally provided with a refractory lining. Gases exiting the oven chamber at a temperature of about 700 to 800° C. are quenched in the gooseneck 12 by means of one (or more) spraying nozzle 18 (spraying process fluid such as ammonia water or the like) down to a temperature of 80-100° C.

Intermediate the gooseneck 12 and the collecting main 14 is a discharge section, generally indicated 19, with a cylindrical (may also be e.g. a conical segment) discharge pipe 20 having a discharge orifice 22. The quenched gas exiting the gooseneck portion 12 thus flows to the collecting main 14 via the discharge section 19. A gate member 24 cooperating with the discharge orifice 22 allows controlling/throttling the gas flow rate to the collecting main 14.

Figure 3:
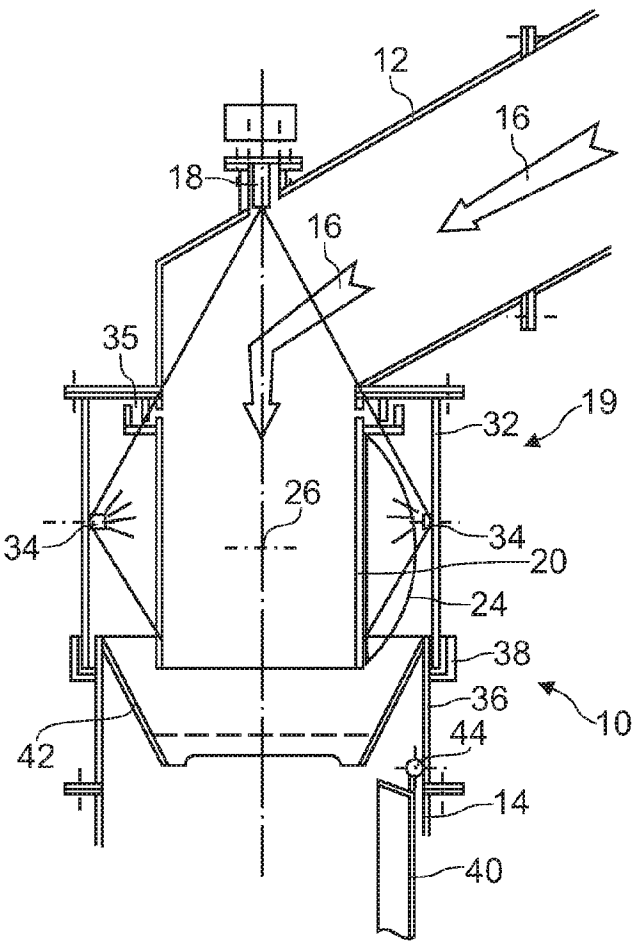
FIG. 3: is a section of the piping system of FIG. 1 with the gate member in the fully open position.
Figure 2:
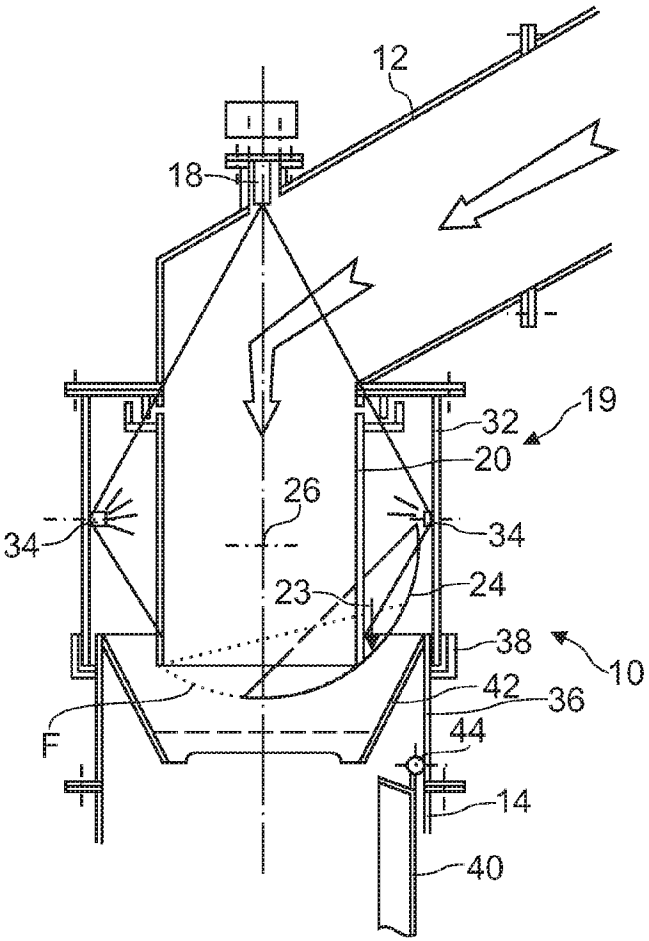
FIG. 2: is a section of the piping system of FIG. 1 with the gate member in a partially open position.
Figure 4:
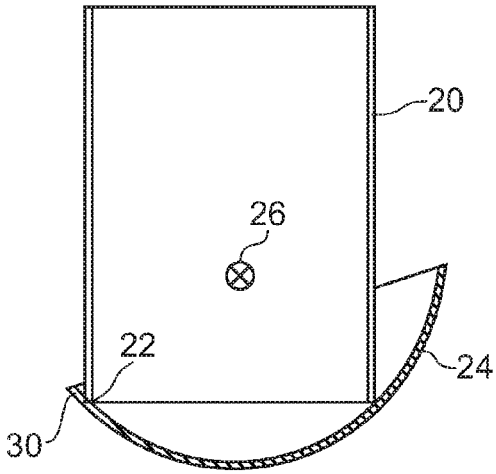
FIG. 4: is a vertical section view through the gate member and discharge pipe of FIG. 1.
Figure 5:
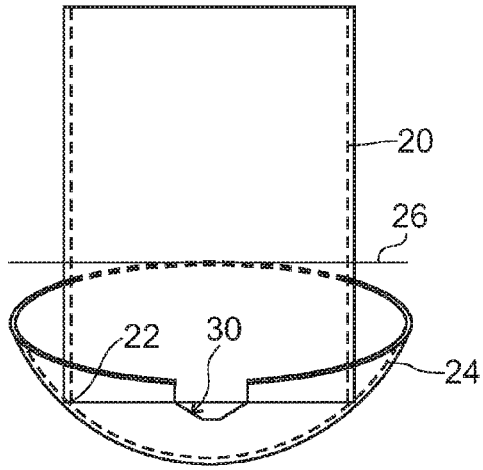
FIG. 5: is a vertical section view through the gate member and discharge pipe of FIG. 1, the cutting plane containing the pivoting axis of the gate member.

It shall be appreciated that the gate member 24 is designed so as to be movable along the discharge orifice 22, which allows varying the opening area of the discharge orifice 22. In the present embodiment the gate member is pivotable about a pivoting axis 26 (perpendicular to the cutting plane of FIG. 1) and presents a generally concave surface profile to the bottom extremity of the discharge pipe 20. The concave surface profile preferably has a centre of curvature located essentially coaxially with the pivoting axis 26, whereby the gate member 24 can be pivoted along the discharge orifice 22. Main operating phases of the present gate member 24 are illustrated in FIGS. 1 to 3. At the beginning of the distillation process, where large amounts of gas are to be drawn off, the gate member 24 is in a fully open position (laterally parked) so that it does not obstruct the discharge orifice 22 (see FIG. 3; also note the compactness of this position). As the distillation goes on, the opening area of the discharge orifice 22 is reduced by pivoting the gate member 24 in the clockwise direction in order to obtain the desired flow conditions through the offtake piping (one partially open position is shown in FIG. 2). In FIG. 1 the gate member 24 is in the closed position and completely obstructs the discharge orifice 22.

In addition, to provide a fine flow control capability, a cut-out 30 is advantageously arranged in the gate member 24 so as to form a variable section opening during a portion of the pivoting stroke of the gate member 24. This can be better understood from FIGS. 4-7, which simply illustrates the gate member 24 and the discharge pipe 20 of the discharge section 19.

Figure 6:
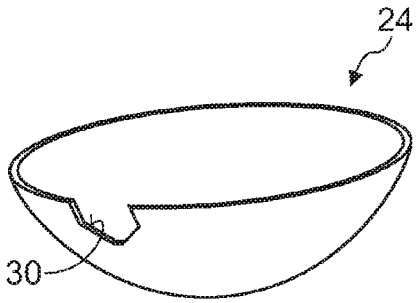
FIG. 6: is a perspective view of the gate member of FIG. 1.
Figure 7:
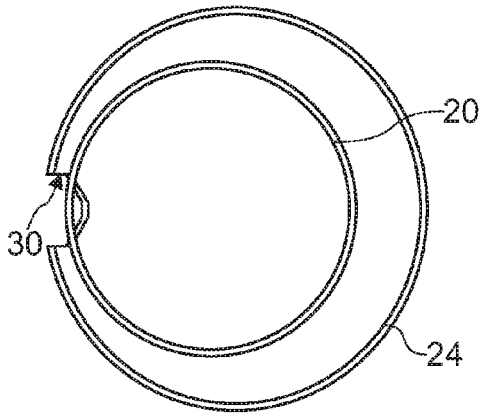
FIG. 7: is a top view of the configuration shown in FIG. 4.
Figure 8:
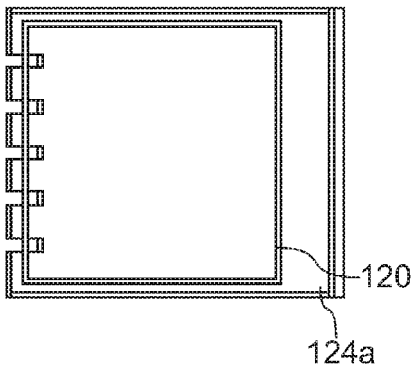
FIG. 8: is a top view of an alternative embodiment with a cylindrical gate member and square discharge pipe.
Figure 9:
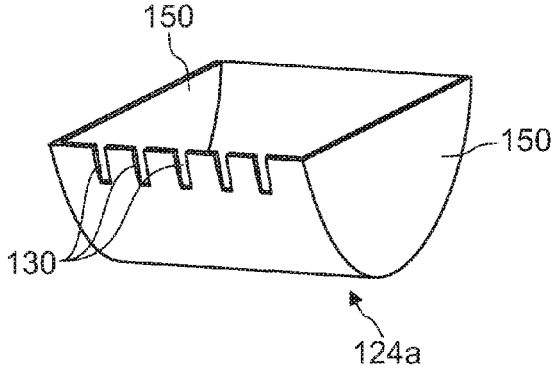
FIG. 9: is a perspective view of the gate member of FIG. 8.
Figure 10:
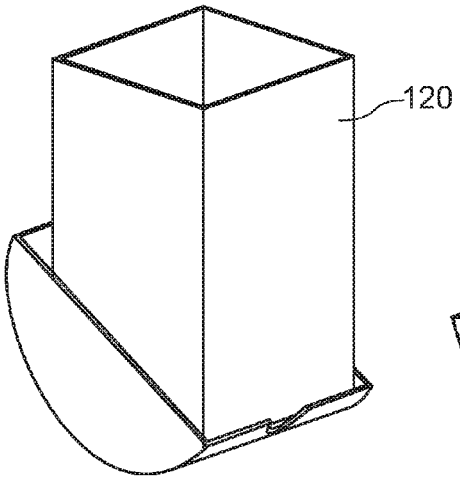
FIG. 10: is a top view of another embodiment with a cylindrical gate member and square discharge pipe.
Figure 11:
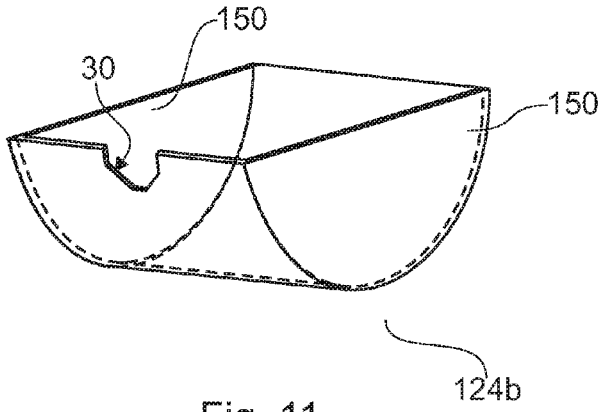
FIG. 11: is a perspective view of the gate member of FIG. 10.

As can be seen in FIG. 6, in the present embodiment the gate member is designed as a spherical cap. A single cut-out 30 extends inwardly from an edge of the gate member 24 (here the cut-out is arranged in the front or "leading" edge portion seen in the closing direction). The cut-out 30 is dimensioned so that in the closed position of the gate member 24 (FIG. 1), its innermost extremity is located outwardly beyond the discharge orifice 22. Logically, the cut-out 30 preferably extends substantially perpendicularly to the pivoting axis 26. In the position of FIG. 1 the discharge orifice is thus completely closed, because the cut-out 30 is beyond the rim of orifice 22.

As mentioned, the aim of the cut-out is to permit a fine flow control capability towards the end of the distillation phase. In the position of FIG. 2 where the gate member 24 partially obstructs the discharge orifice, the opening area corresponds to the area defined between the rim of the discharge orifice 22 and the peripheral, leading edge of gate member 24. As the gate member is further closed (further pivoting in the clockwise direction) the gate member 24 moves to the left along the discharge orifice 22 and covers and increasingly greater proportion of the discharge orifice 22. Once the foremost point of the leading edge arrives below the rim of the discharge orifice (position indicated F with phantom lines in FIG. 2), the discharge orifice 22 is fully obstructed by the gate member 24, except at the location of the cut-out 30. Pivoting the gate member 24 further in the clockwise direction will progressively reduce the opening area (see e.g. FIG. 7) defined by the cut-out 30 and the rim of the discharge orifice until the cut-out passes beyond the rim (FIG. 1).

The discharge pipe 20 and gate member 24 thus act as a throttling valve in the present offtake piping system, which has a fine flow control capability that is useful for controlling the pressure and flow towards the end of distillation phase.

Any appropriate drive means (not shown) may be used for pivoting the gate member about its axis 26. Typically the gate member may be supported by one or two arms, whose opposite extremities can be housed in bearings coinciding with the pivoting axis. The actuation mechanism may be designed to permit manual and/or automated actuation.

Another advantageous design aspect of the present throttling valve is that due to the spherical inner shape of the gate member 24 and to the location of its pivoting axis 26, it can be pivoted about the discharge orifice 22 with a constant operating gap between the bottom extremity of tube 20 and the inner cavity of the gate member 24. Minimizing this operating gap permits limiting gas leakages. Indeed, when desiring to finely control the gas flow rate through the variable section opening formed with the cut-out 30 as in FIG. 5, it is preferable to avoid significant gas leakages between the gate member 24 and discharge pipe 20. The present design thus permits to avoid such leakages. The operating gap may e.g. be of about 1 mm, but is preferably less than one mm.

As mentioned above, in the position of FIG. 1 the gate member 24 completely obstructs the discharge orifice 22. In addition, the peripheral edge of the gate member 24 extends above the discharge orifice 22. Hence, in the closed position, process liquid will accumulate in the cavity formed by the gate member and rise to a level above the discharge orifice 22, thereby forming a hydraulic seal. In such case, the present throttling valve can also sealingly close the communication between the oven chamber and the collecting main 14, so that no other closing valve is required.

In the present embodiment, the discharge section 19 comprises a discharge cage 32 in which the discharge pipe 20 extends. Spray means 34 are arranged so as to spray process fluid on the outer surface of the discharge pipe 20. It may be noticed that in the configuration of FIG. 2 where the gate member 24 is in a partially open position, the process fluid will collect in the upper, outer region of the gate member and form a hydraulic seal about the operating gap between the discharge pipe 20 and gate member 24 (as indicated by arrow 23). Use of ammonia water e.g., as for spraying nozzle 18, also permits cleaning of the piping elements.

In order to prevent excessive process fluid accumulation in the closed position of the gate member 24 up to the gooseneck 12, overflow means 35 are advantageously arranged in the upper part of the discharge pipe 20. As can be understood from FIG. 1, liquid rising up to the level of the overflow means 35 will be evacuated through the overflow means 35 and fall in the discharge cage 19. Under normal operating conditions a certain level of water remains in the overflow means 35, which avoids gas leakage.

The discharge section 19 is connected to the collecting main 14 via an expansion joint realized between the bottom of the cage 32 and a cylindrical connecting portion 36 bearing a U-shaped peripheral rim 38. The U-shaped rim 38 is filled with tar or like material and thus provides a sealed joint with some expansion capability, as known in the art. Connecting portion 36 has a flanged bottom by means of which it is screwed to the collecting main 14.

Although not required since the present configuration of gate member 24 allows to sealingly close the discharge opening 22, a conventional pot-valve 40 can be arranged downstream of the gate member 24. Here the pot-valve 40 cooperates with a frustoconical sleeve 42. In FIG. 1 the pot valve 40 is in the closed position: it bears against the bottom of sleeve 42. In such position, the pot-valve fills up with process falling from above and forms a hydraulic seal, as is well known. In FIGS. 2 and 3, pot valve 40 has been pivoted about axis 44 in its open position.

FIGS. 8-11 illustrate alternative configurations with a cylindrical gate member 124*a* or 124*b* and square discharge pipe 120. To provide a liquid collecting cavity, the ends of the cylinder are closed by walls 150; this is however not mandatory should a hydraulically sealed gate not be required. Gate member 124*b* (FIG. 11) is provided with a single cut-out 30 of similar shape than gate member 24, whereas gate member 124*a* bears a set of five cut-outs 130. As it is clear from the drawings, the opening and flow control principle is the same as for the embodiment of FIGS. 1 to 7.

It may be noted that in the case of a cylindrical gate member, the pivoting axis of the gate member may be slightly shifted (from one to several mm) from the centre of curvature of the cylinder, so as to obtain a metal to metal contact between gate member 124*a* or 124*b* and the discharge pipe 120 on the side bearing the cut-out(s). These axes may however also be coaxial.

The above embodiments provide an offtake piping with improve flow control capapility, permitting a precise control of oven backpressure. The gate member 22 may act as a shutoff and throttling member that offers the possibility of continuously controlling the oven pressure during distillation time, with a fine control function. This flow control capability permits to avoid overpressure during the first phase of the distillation process, by maintaining a negative pressure in the collecting main, whereby emissions from doors, charging holes etc. can be fully reduced. Moreover, a continuous oven pressure control allows avoiding negative relative pressures at the oven bottom during the last phase of distillation when the coke gas flow rate is low. Coke oven pressure control thus permits to achieve both emission reduction (during first phase of distillation) and prevention of air infiltration (during last distillation phase).

Figure 12:
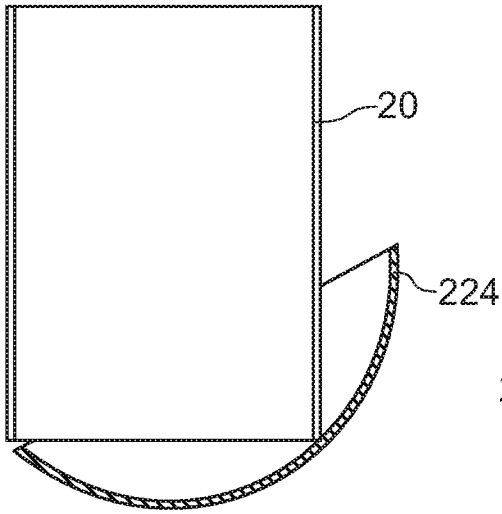
FIG. 12: is vertical section view through an alternative embodiment of cooperating gate member and discharge pipe.
Figure 13:
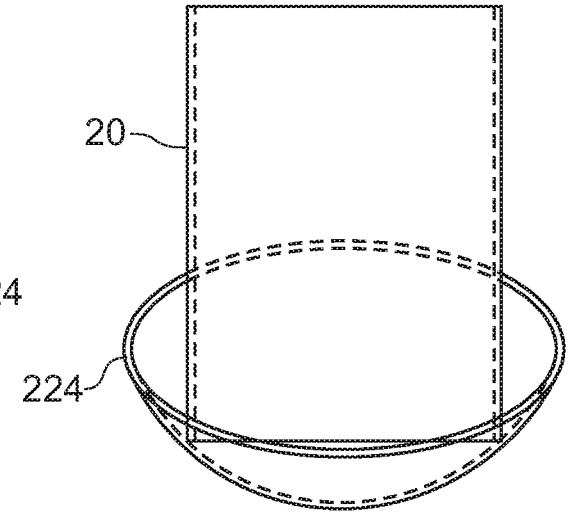
FIG. 13: is a front view of FIG. 12.
Figure 14:
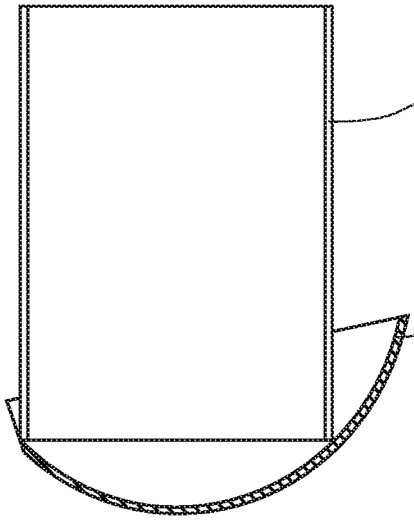
FIG. 14: is vertical section view through another alternative embodiment of cooperating gate member and discharge pipe.
Figure 15:
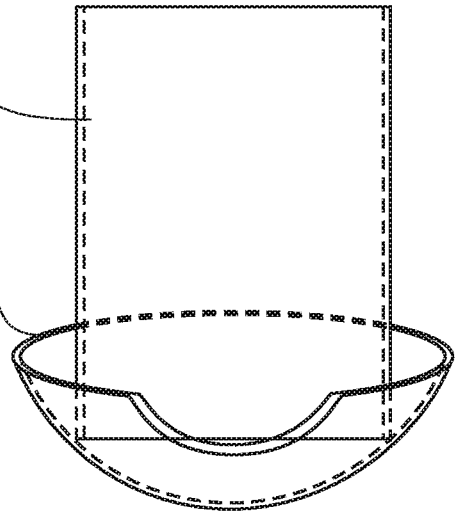
FIG. 15: is a front view of FIG. 12.
Figure 16:
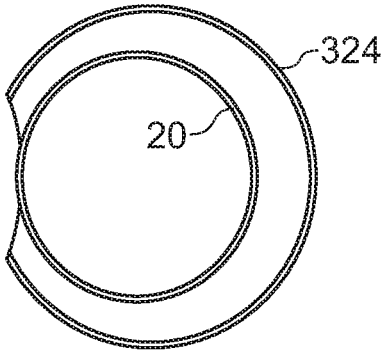
FIG. 16: is a top view of FIG. 14.
Figure 17:
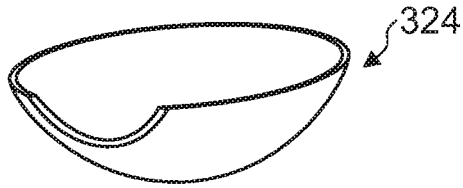
FIG. 17: is a perspective view of the gate member of FIG. 14.

Turning now to FIGS. 12 and 13, they concern an alternative embodiment where the gate member 224 is a full spherical cap (i.e. without cut-out) associated to a circular discharge pipe 20.

FIGS. 14-17 show another embodiment using a truncated spherical cap 324 as gate member: as can be understood from the Figs., the leading edge of the gate member 324 is flat. It corresponds to a cut in a vertical plane when the cap 324 lies on its vertex (see FIG. 4 e.g.). Compared to the full spherical cap 224, this design makes it easier to control fine flows (compare FIGS. 12 and 14, resp. 13 and 15).

Figure 18:
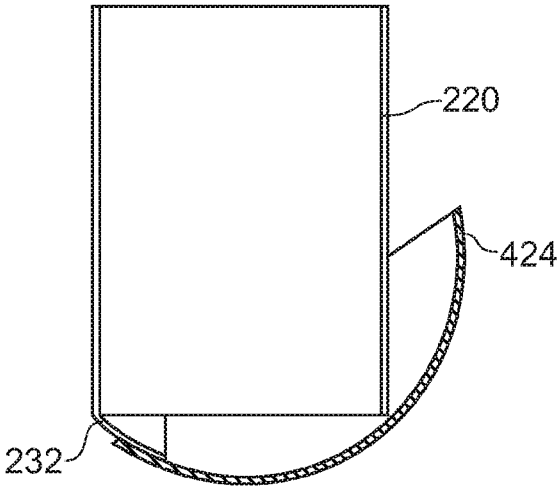
FIG. 18: is vertical section view through a further alternative embodiment of cooperating gate member and discharge pipe.
Figure 19:
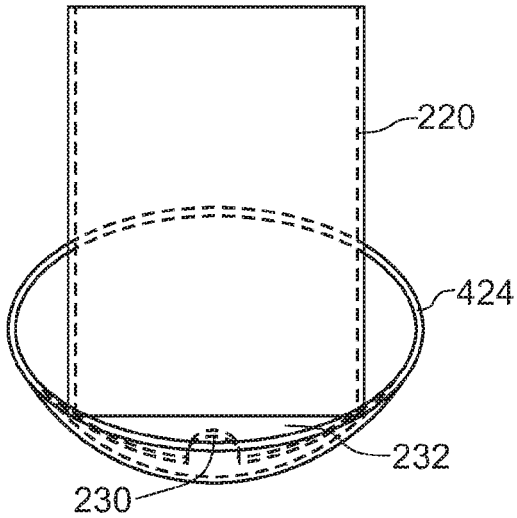
FIG. 19: is a front view of FIG. 18.
Figure 20:
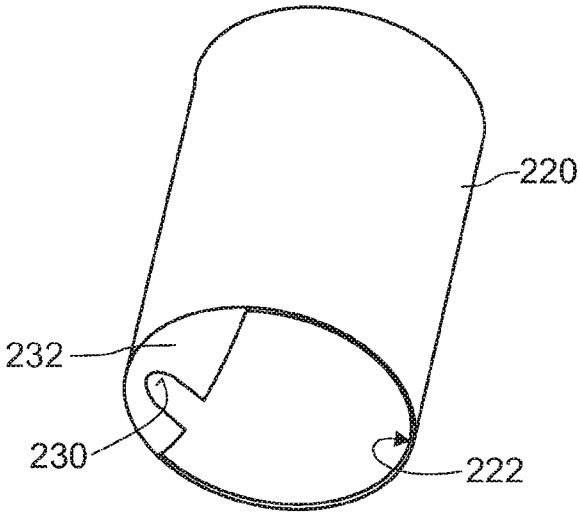
FIG. 20: is a perspective view, from below, of the discharge pipe of FIG. 18.

Finally, a further embodiment of the valve design is illustrated in FIGS. 18-20. Here the gate member is a full spherical cap (i.e. without cut-out) and the cut-out 230 for fine flow control is arranged in the discharge pipe 220. As can be seen, on the closing side of the discharge pipe 220, the latter has a lip 232 portion extending inwardly and having the same curvature as the gate member 424. The cut-out 230 is arranged in this lip 232. Towards the end of the closing stroke of the gate member 424 this cut-out 230 provides a fine flow control capability, until the discharge orifice 222 is fully obstructed.

As it will be understood, the person skilled in the art may design the gate member so that its leading edge has a profiled shape (with one or more cut-out or truncated segment), which is formed so as to provide a desired flow characteristic (flow vs stroke position) towards the end of the closing stroke/movement.

Figure 22:
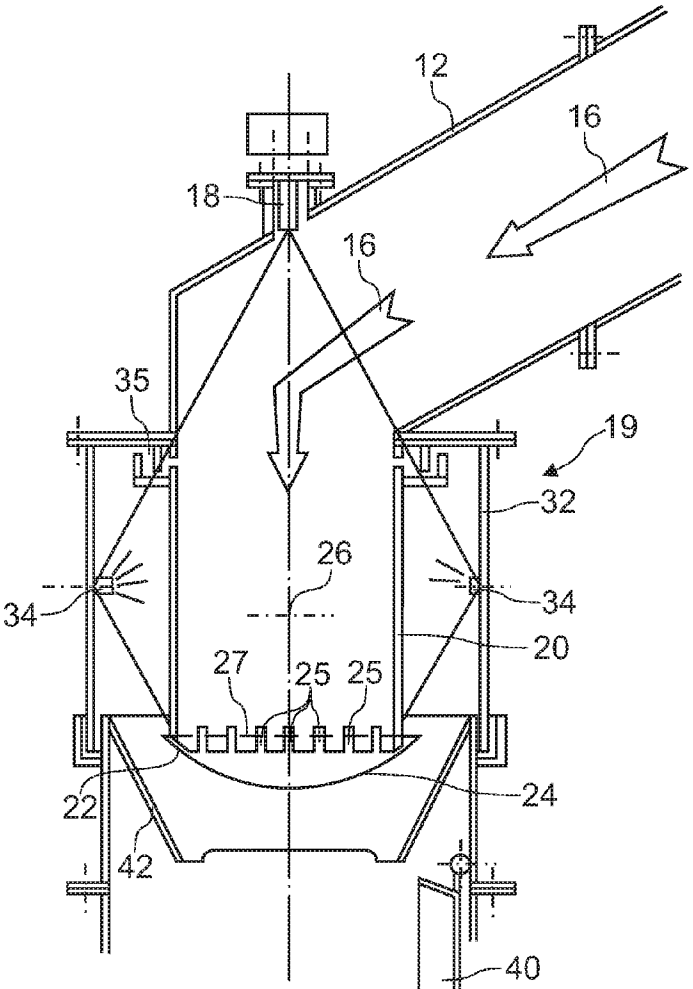
FIG. 22: is a view of the piping system of FIG. 21 with the gate member in a Partially open position.
Figure 21:
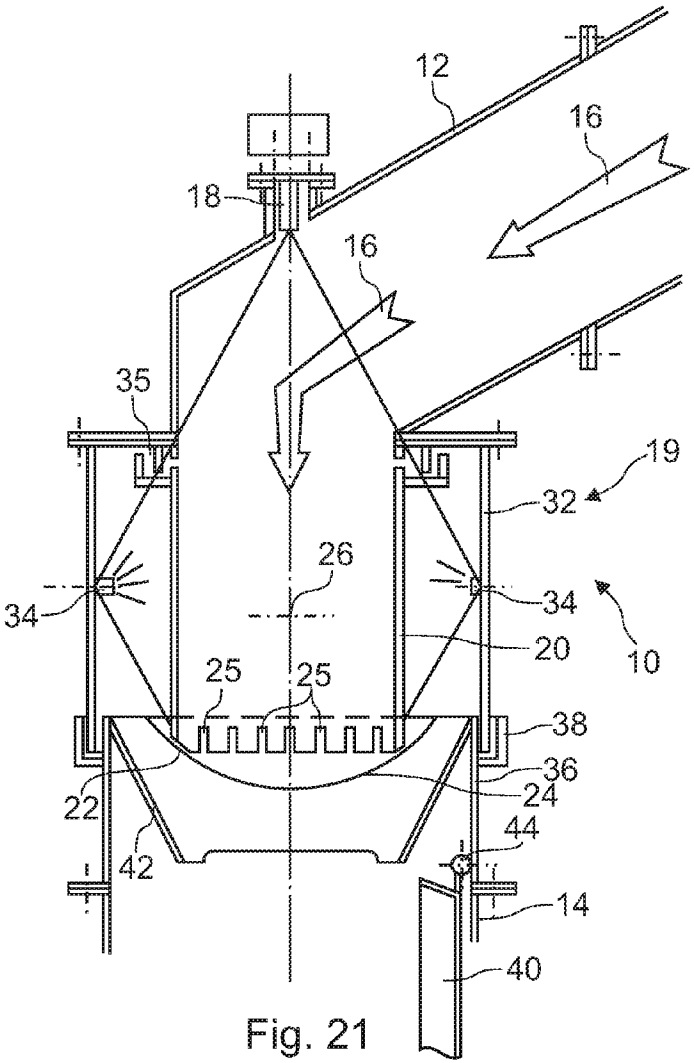
FIG. 21: is a vertical section view through another embodiment of a coke oven offtake piping system, where the bottom of the discharge pipe has a plurality of cut-outs and the gate member is shown in the closed position.
Figure 23:
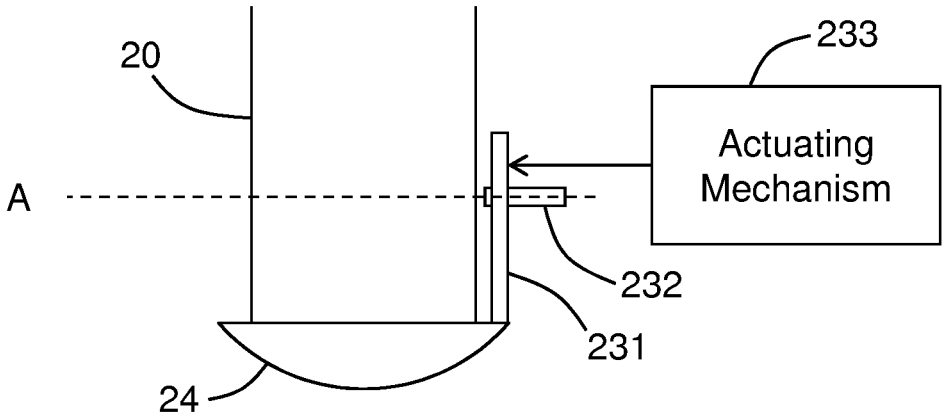
FIG. 23 illustrated a portion of a coke oven offtake piping system.
Figure 24:
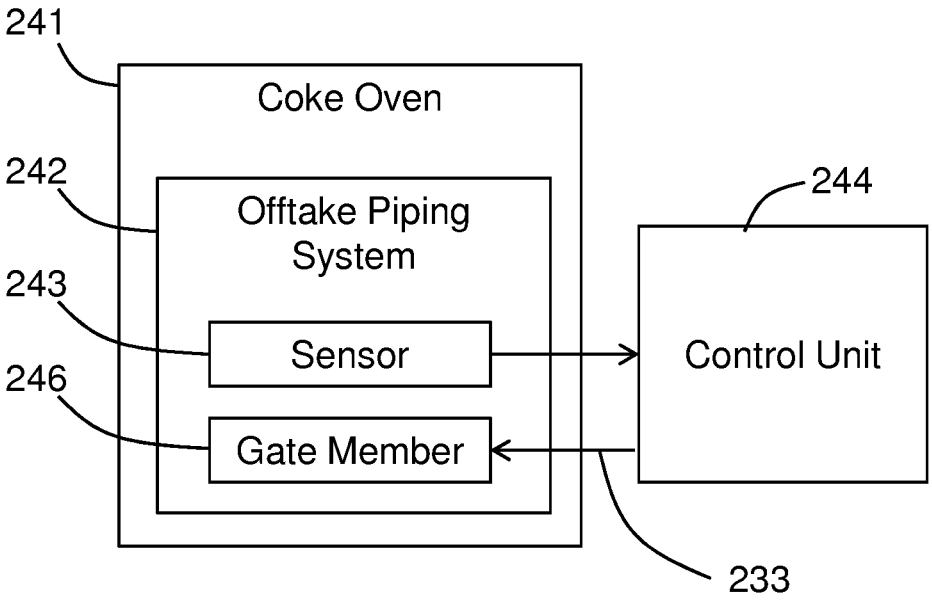
FIG. 24 illustrated a block diagram of a control system for controlling a gate member of an offtake piping system.
Figure 25:
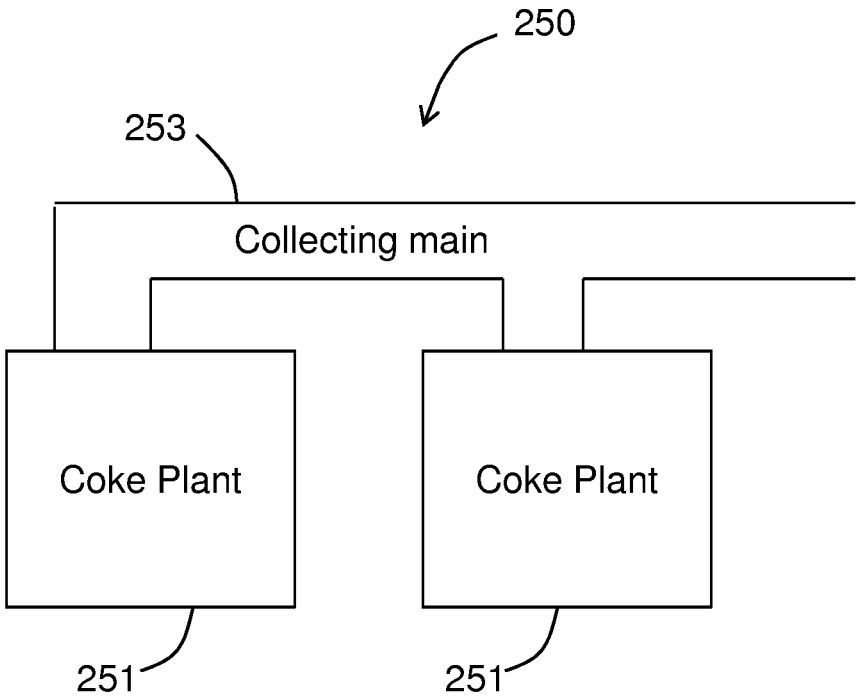
FIG. 25 illustrated a block diagram of a coke plant according to an embodiment of the invention.

Still a further embodiment of the present invention is illustrated in FIGS. 21 and 22, which essentially varies from the embodiment of FIG. 1 in that the bottom end of discharge pipe 20 is provided with a plurality of cut-outs 25. The cut-outs 25 extend inwardly (here axially and upwardly) from the discharge orifice 22. The gate member 24, preferably taking the form of a spherical cup, and the cut-outs 25 are configured so that in the closed position of FIG. 21, the peripheral borders of the gate member 24 extend upwardly above the upper, closed end of the cut-outs 25. Hence, when the gate member 24 is completely filled with process liquid having accumulated in its cavity, the liquid level is at a level above the openings formed by the cut-outs 25, thereby forming a hydraulic seal.

It may be noted that this embodiment allows a fine throttling of the gases towards the end of the closing stroke based on the liquid level. Indeed, the liquid level in the gate member 24 and the angular position of the latter to define a throttling area through the cut-outs 25. For example in FIG. 22 the level of liquid is indicated 27; the top region of the cut-outs 25 is thereby not obstructed by the process liquid and the gas flow is made possible therethrough. The flow area through the cut-outs 25 is thus dependent on the angular position of the gate member 24 and level of liquid therein. In other words, the gas flow rate is set by adjusting the angular position of the gate member so as to control the leak flow of process liquid.

The invention claimed is:

1. A coke oven offtake piping system comprising:

a pipe assembly for conveying coke oven gases from a coke oven to a collecting main;

at least one spraying nozzle in said pipe assembly;

said pipe assembly comprising a discharge section with a discharge pipe having a discharge orifice; and a gate member cooperating with said discharge orifice, said gate member being movable along said discharge orifice in order to present a closing surface to the extremity of said discharge pipe, whereby the opening area of said discharge orifice can be varied for controlling the flow rate to said collecting main;

wherein that said gate member is a spherical cap with a concave closing surface, said gate member configured to pivot around a pivoting axis to expose said discharge orifice and to cover said discharge orifice, respectively.

2. Coke oven offtake piping system according to claim 1, wherein said spherical cap has a center of curvature located about said pivoting axis.

3. Coke oven offtake piping system according to claim 2, wherein said center of curvature is substantially coaxial with said pivoting axis.

4. Coke oven offtake piping system according to the claim 1, wherein at least one cut-out is arranged in said gate member or in said discharge pipe about said discharge orifice so as to form a variable section opening towards the end of the closing stroke of said gate member.

5. Coke oven offtake piping system according to claim 4, wherein said at least one cut-out is provided in said gate member and extends inwardly from an edge thereof.

6. Coke oven offtake piping system according to claim 1, wherein said gate member is a truncated spherical cap having a shape corresponding to a portion of a sphere having edges defined by two crossing planes.

7. Coke oven offtake piping system according to claim 1, wherein, in the closed position of said gate member, the peripheral borders of said gate member extend upwardly above the extremity of the discharge orifice so that a hydraulic seal forms as process fluid collects in a gate member cavity.

8. Coke oven offtake piping system according to claim 1, wherein said discharge pipe extends in a discharge cage connected to the collecting main; and spray means are provided in the discharge cage to spray the outer wall of said discharge pipe.

9. Coke oven offtake piping system according to claim 8, wherein said spray means are arranged in said cage so that in certain partially open positions of the gate member, sprayed fluid flows between the outer wall of the discharge pipe and a gate member cavity and form a hydraulic seal.

10. Coke oven offtake piping system according to claim 8, wherein said discharge section comprising said discharge pipe and surrounding discharge cage is inserted in-between a gooseneck and said collecting main; and wherein said at least one spraying nozzle is arranged in said gooseneck.

11. Coke oven offtake piping system according to claim 8, comprising overflow means integrated in said discharge pipe, for evacuating excess water into said discharge cage.

12. Coke oven offtake piping system according to claim 1, comprising a pot valve downstream of said discharge orifice.

13. Coke oven offtake piping system according to claim 1, comprising manually and/or automatically operable drive means for said gate member.

14. Coke oven offtake piping system according to claim 1, wherein said gate member has a leading edge with a profiled shape, which is designed to provide a desired flow characteristic towards the end of the closing stroke.

15. Coke oven offtake piping system according to claim 1, wherein the discharge pipe is provided with a plurality of cut-outs extending inwardly from the discharge orifice;

said closing surface of said gate member has a generally concave surface profile and said gate member has a pivoting axis allowing its pivoting along said discharge orifice; and in the closed position of said gate member, the peripheral borders of said gate member extend upwardly above the inner end of said cut-outs in said discharge pipe.

16. Coke oven offtake piping system according to claim 1, comprising a control unit responsive to pressure sensors in the coke oven and connected to operate actuating means associated with said gate member; said control unit being configured to progressively adjust the position of the gate member relative to the discharge orifice to provide a progressive constriction of the discharge opening as the pressure varies in the oven chamber.

17. A coke plant comprising a battery of coke ovens and a collecting main, wherein the gases from each single oven are lead to said collecting main via a coke oven offtake piping system according to claim 1.

18. Method of controlling the gas flow rate from coke ovens, comprising a battery of coke oven chambers each connected to a collecting main by a respective coke oven offtake piping system according to claim 1, comprising the steps of detecting the oven pressure in the individual coke oven chambers by means of pressure sensors, and based on the detected pressure, progressively adjusting the position of the gate member relative to the discharge orifice to provide a progressive constriction of the discharge opening as the pressure varies in the oven chamber.

* * * * *